US006435887B2

(12) United States Patent
Koitsalu

(10) Patent No.: US 6,435,887 B2
(45) Date of Patent: Aug. 20, 2002

(54) ESD PROTECTING DEVICE

(75) Inventor: Evald Koitsalu, Stockholm (SE)

(73) Assignee: Telefonaktiebolaget L M Ericsson, Stockholm (SE)

( * ) Notice: Subject to any disclaimer, the term of this patent is extended or adjusted under 35 U.S.C. 154(b) by 0 days.

(21) Appl. No.: 09/745,683

(22) Filed: Dec. 21, 2000

(30) Foreign Application Priority Data

Dec. 30, 1999 (SE) ..... 9904862

(51) Int. Cl.[7] ..... H01R 13/26
(52) U.S. Cl. ..... 439/188; 200/51.1
(58) Field of Search ..... 439/188; 200/51.04, 200/51.1, 51.09, 51.02

(56) References Cited

U.S. PATENT DOCUMENTS 4,179,178 A * 12/1979 Bachman et al. ..... 200/51.1 X
4,955,817 A 9/1990 Sugai ..... 439/60
5,564,933 A 10/1996 Bouchan et al. ..... 439/76
6,015,311 A * 1/2000 Benjamin et al. ..... 439/188 X

FOREIGN PATENT DOCUMENTS

EP 0406610 A2 1/1991
EP 0532166 A1 3/1993
EP 0717472 A3 6/1996

OTHER PUBLICATIONS

Sandh, H. International–Type Search Report, App. No. SE 9904862–1, Sep. 5, 2000, pp. 1–8.

* cited by examiner

*Primary Examiner*—Renee Luebke
(74) *Attorney, Agent, or Firm*—Jenkens & Gilchrist, P.C.

(57) ABSTRACT

A memory card receptacle 20 comprising at least one contact 30 (37, 38) for electrically contacting a memory card 18. The memory card receptacle 20 has at least one grounding contact member 36, for protecting electronic equipment 10 against electro static discharge (ESD), whereat each contact 30 (37, 38) is in contact with said grounding contact member when there is no memory card 18 inserted in the memory card receptacle 20. A portable radio communication station having SIM chip card reader according to the invention is disclosed.

21 Claims, 7 Drawing Sheets

ESD PROTECTING DEVICE

TECHNICAL FIELD OF THE INVENTION

This invention relates to devices for protecting electronic equipment against electro static discharge (ESD).

TECHNICAL BACKGROUND

A memory card is often used in different electronic equipment having a control unit. A memory card is a bearer of information that is readable by the control unit in said electronic equipment. A user can change the features of electronic equipment by changing the memory card to a new one containing different information. In portable transceivers, like mobile stations for mobile radio telecommunication, a memory card is used that contains subscriber and operator information. This card is called a SIM chip card (Subscriber Identification Module). An interface providing electrical connections between a SIM chip card and electronics internal to the portable transceiver is called a SIM chip card reader. Once the SIM chip card is retained in the reader, sliding contacts of the reader are coupled to the SIM chip card contacts, allowing the portable transceiver access to the information stored within the SIM chip card. The electrical operation of the SIM chip card is described in International Standards Organisation (ISO) Document #7816-3: 1988 (E), Technical Committee ISO/TC 97, Information Processing Systems, May 15, 1988 (First Edition).

Developments have resulted in smaller electronic components and circuits internal to the portable transceiver that is working at lower and lower drive voltages. Said electronics and circuits become therefore more sensitive to ESD charges that could rise to many thousands of volts. The contacts of the reader could conduct said high charges to said electronics causing a lot of damage inside the transceiver.

DESCRIPTION OF THE INVENTION

One object of this invention is to provide a design that solves the problem to protect electronic equipment having a memory card receptacle against ESD damage.

This object is achieved by providing said memory card receptacle with at least one grounding contact member.

A more detailed description of the invention is that the memory card receptacle has at least one grounding contact member, whereat each contact of the memory card receptacle is in contact with a grounding contact member when there is no memory card inserted into the device.

The advantage is that any static discharge electric charges will have a controlled discharge path and the components of an electronic equipment device will be protected against expensive damages caused by high ESD charges.

The invention will now be described in more detail with reference to the enclosed drawings.

SHORT DESCRIPTION OF DRAWINGS

PREFERRED EMBODIMENTS

Figure 1:
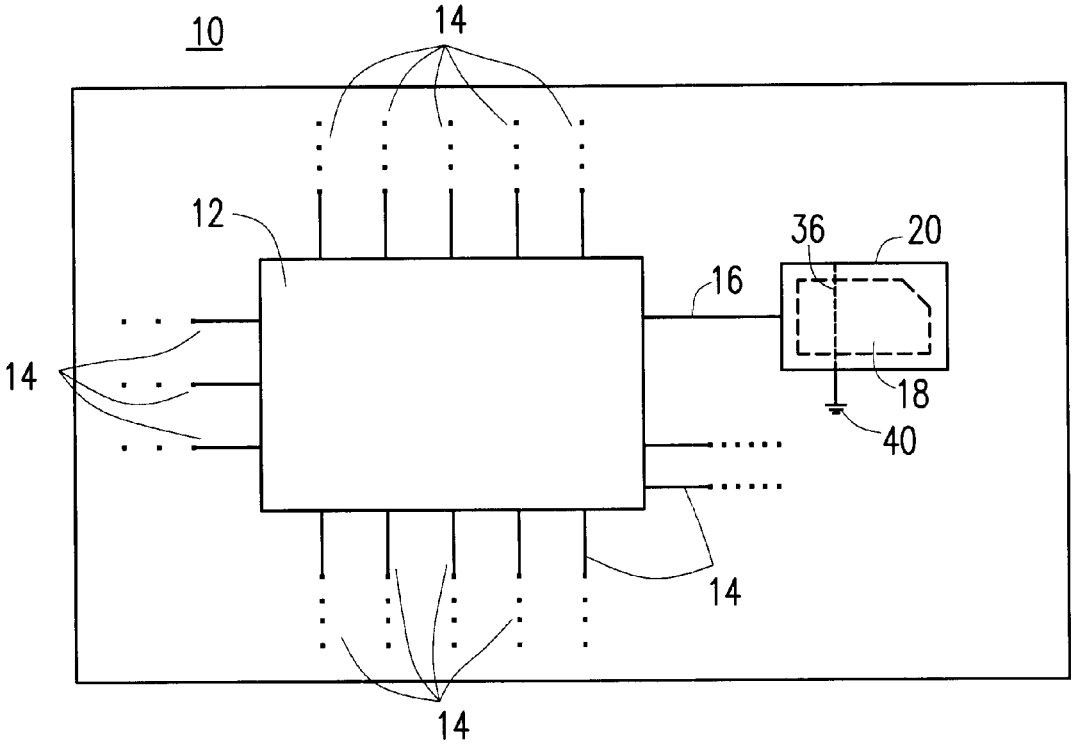
FIG. 1 is a schematic view of an electronic equipment device 10 comprising a memory card receptacle.

FIG. 1 is a schematic view of an electronic equipment device 10 comprising a memory card receptacle 20 and a control unit 12 that comprises at least one processor for controlling other units of the device. Said units are coupled to in/out ports 14 of the control unit. The memory card receptacle 20 is an interface for connecting a memory card 18 to the control unit via a data bus 16. A user can insert the card into the receptacle 20 or take it out when appropriate. The receptacle 20 makes it possible for the control unit 12 to electrically read the information stored in the memory card 18.

For an example the electronic equipment device 10 could be a portable radio communication station in a mobile radio telecommunication system. In such a system the memory card 18 is identified as a Subscriber Identification Module (SIM) and the memory card receptacle 20 as a SIM chip card reader. In the following the broader terms memory card 18 and memory card receptacle 20 will be used in the description, but said terms are regarded as equivalent to and therefore replaceable with the terms SIM card and SIM (chip) card reader respectively or corresponding terms in a mobile radio telecommunication system, as long as the function and design of the devices are identical.

A preferred embodiment of the invention will now described in more detail with references to FIGS. 2–6.

Figure 2:
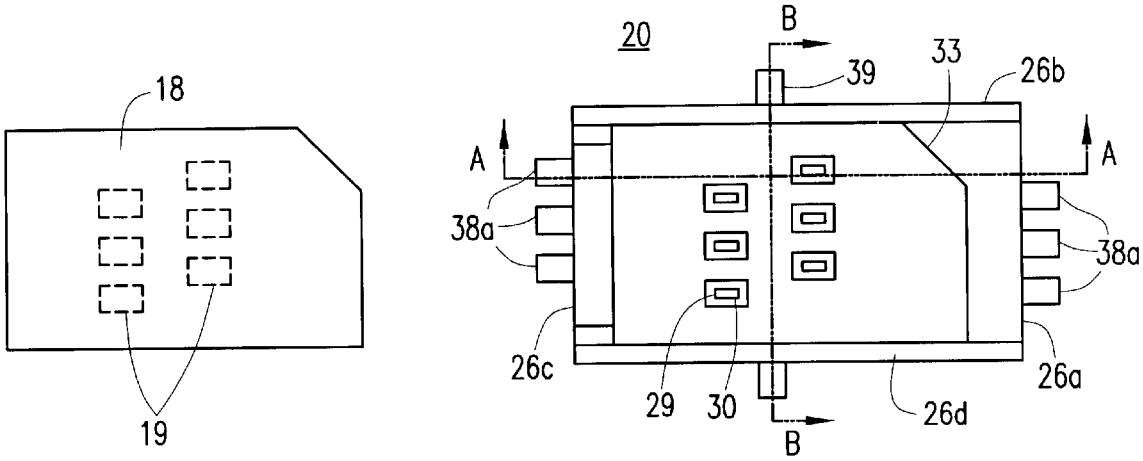
FIG. 2 is a schematic top view revealing a memory card and a preferred embodiment of a memory card receptacle.

A top view revealing a memory card 18 and a preferred embodiment of a memory card receptacle 20 is shown in FIG. 2. The memory card has a number of electric contacts, memory card contacts 19. The device 20 is a construction comprising a top lid (not shown), four sidewalls 26*a–d,* a contact cover 28 and at least one contact 30. Each contact 30 is situated under the contact cover 28, which has recesses 29 for letting a part of each contact 30 protrude through the contact cover 28 into a memory card space 32. The shown embodiment includes six contacts protruding through the contact cover 28.

The memory card receptacle 20 has to have the same number of contacts 30 as the memory card 24 has memory card contacts 19 and the position of each contact 30 is determined by the position of corresponding memory card contact 19.

The combination of the top lid 23, the contact cover 28 and three of the sidewalls 26 forms the memory card space 32. The fourth side wall 26 has a slot or opening 63 enabling insertion and rejection of the memory card. The card space 32 includes a raised triangular shaped polarizer 33 disposed in one corner of the memory card space 32. The triangular shaped polarizer 33 ensures that the memory card 24 has been inserted on the proper side and in the proper direction. The three walls 26 create a retention area 34 that is formed to the size and shape of the memory card 24, where the memory card 24 will rest when it has been properly aligned. The contacts 30 are properly electrically coupled to the memory card 24 when the card is aligned.

Figure 3:
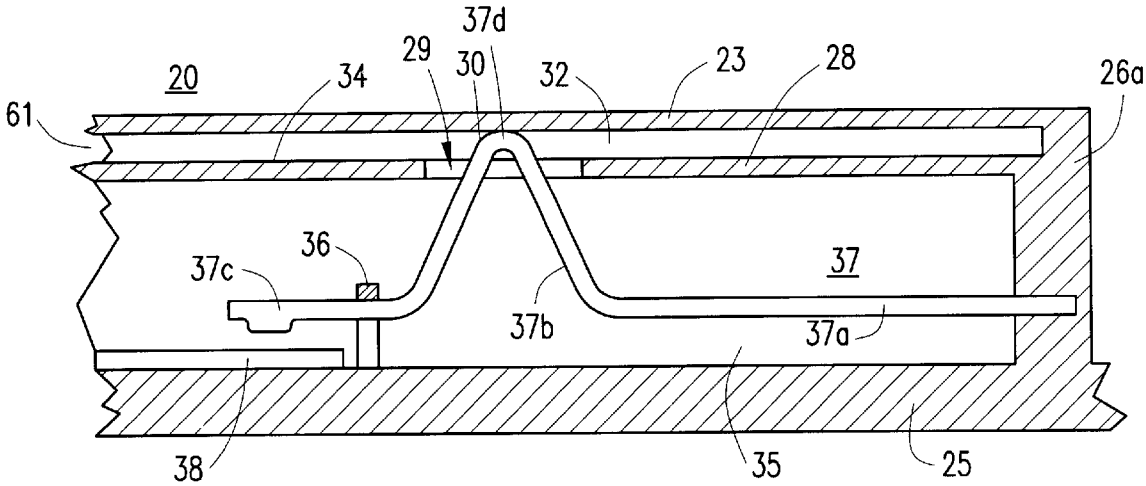
FIG. 3 is a schematic partial cross-sectional transverse view of the memory card device interior taken on the line A—A of FIG. 2.

FIG. 3 is a schematic partial cross-sectional transverse view of the memory card device interior taken on the line A—A of FIG. 2 showing a side view of the preferred embodiment with one of its electrical contacts 30.

The memory card receptacle 20 can have an integrated base, a so called base cover 25, or be attached to a surface e.g. a surface of a printed circuit board (PCB) or another suitable construction detail of an electronic equipment 10. Such a surface or construction detail will serve as a base cover 25. There is a contact chamber 35 between the walls, the 20 base cover 25 and the contact cover 28. Said contact chamber 35 contains the contacts 30 and at least one grounding contact member 36. This embodiment makes use of only one grounding contact member 36. However, in other embodiments more than one grounding contact member 36 can be used. For an example, in one embodiment each contact 30 can have its own grounding contact member 36.

Each contact 30 comprises a movable contact member and signal contact member. In this embodiment the movable contact member comprises a bendable arm portion 37*a,* an extension portion 37*c* and a n-shaped portion 37*b* coupled in between the arm portion 37*a* and the extension portion 37*c*. One end of each contact member is fixed in one of the sidewalls 26*a*. An electrical conducting part of the contact, in this embodiment it is the extension portion 37, will rest at the grounding contact member 36 when the protruding n-shaped portion 37*b* is not in contact with the memory card. Each unloaded contact 30 extends parallel to each other and to the retention area 34. The bendable contact member 37*a* is coupled to a n-shaped portion 37*b,* with a curved part of the n-shaped portion protruding into the memory card space 32 between the top lid 23 and the contact cover 28, thereby forming a contact portion 37*d* that easily slides against the surface of the memory card during the insertion or ejection of said card.

Figure 4:
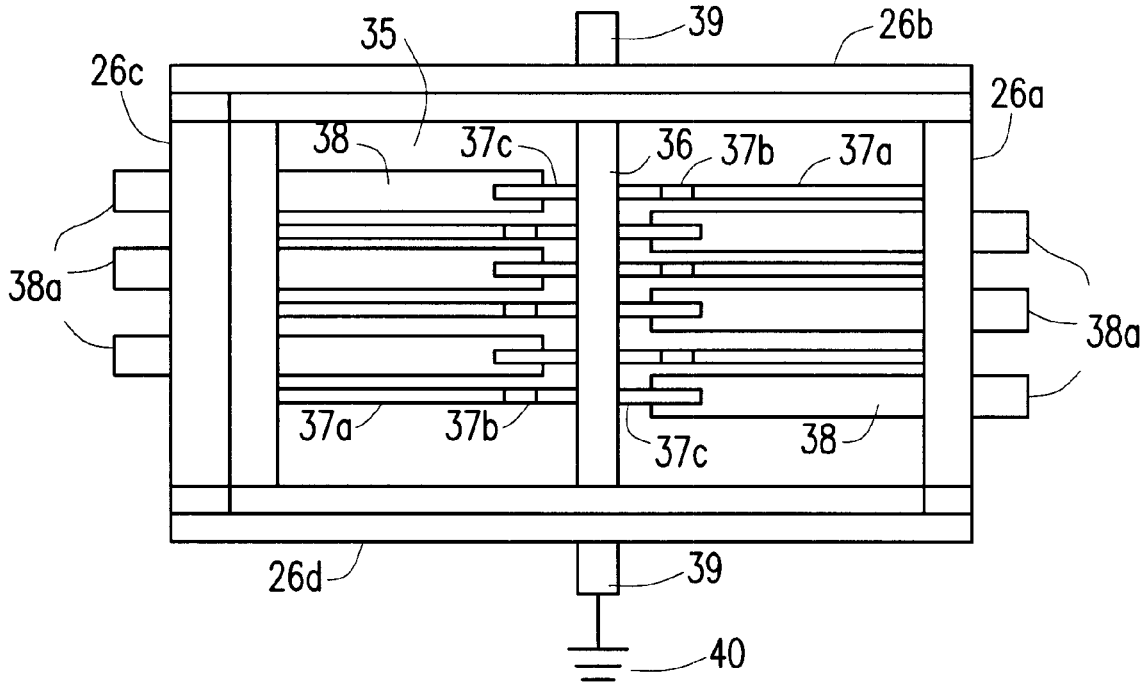
FIG. 4 is a schematic top view of the memory card device.

FIG. 4 is a schematic top view of the memory card device with both the top lid 23 and the contact cover 28 lifted off the device. Each of the six contacts comprise a bendable arm portion 37*a,* an extension portion 37*c* and a n-shaped portion 37*b* sitting in between the arm portion 37*a* and the extension portion 37*c*. Each movable arm 37 protrudes from opposite sidewalls 26*a,* 26*c* into the contact chamber 35. An electrical conducting part of the contact, in this embodiment the extension portion 37*c,* will rest at the grounding contact member 36 when the movable contact member 37 is not in contact with the memory card 18.

This embodiment has only one grounding contact member 36. It is located in the middle of the contact chamber 35, an equal distance from each of the sidewalls 26*a, c* where the contacts are fixed. The grounding contact member 36 is U-shaped and crosses all contacts 30 and protrudes through at least one of the sidewalls 26*b,* 26*d,* which is parallel to the contacts 30 (37, 38), to the outside of the memory card receptacle 20. As disclosed in this embodiment the signal contact member 38 protrudes through both said sidewalls 26*a,* 26*c*. At least one of the protruding parts, called grounding contact terminals 39, of the grounding contact member 36 shall be connected to the grounding shield 40 of the electronic equipment device 10. Said connection (by gluing, contacting, soldering etc.) to the grounding can easily be made by a person skilled in the art.

Figure 5:
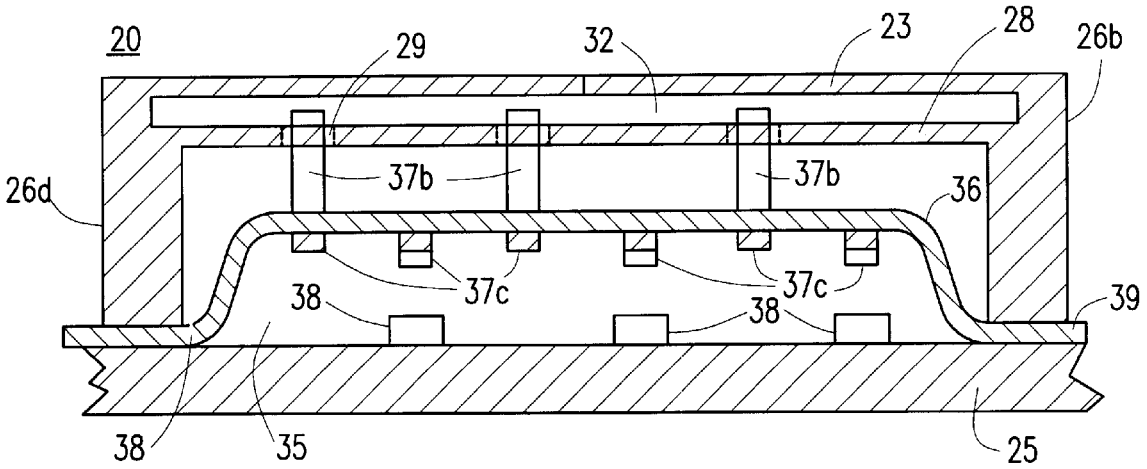
FIG. 5 is a schematic partial cross-sectional transverse view of the memory card receptacle interior taken on the line B—B of FIG. 2 showing a front view of the preferred embodiment.

FIG. 5 is a schematic partial cross-sectional transverse view of the memory card receptacle 20 interior taken on the line B—B of FIG. 2 showing a front view of the preferred embodiment.

Said FIG. 5 discloses the top lid 23, the contact cover 28, the sidewalls 26*b, d,* the six contacts 37*c* and the grounding contact member 36. The n-shaped portion of the movable contact member is protruding into the memory card retention space 32 through the recesses 29 of the contact cover 28. An electrical conducting part of the contact, in this embodiment it is the extension portion 37*c,* will rest at the grounding contact member 36 when the n-shaped portion 37*b* not is in contact with a memory card.

Figure 6:
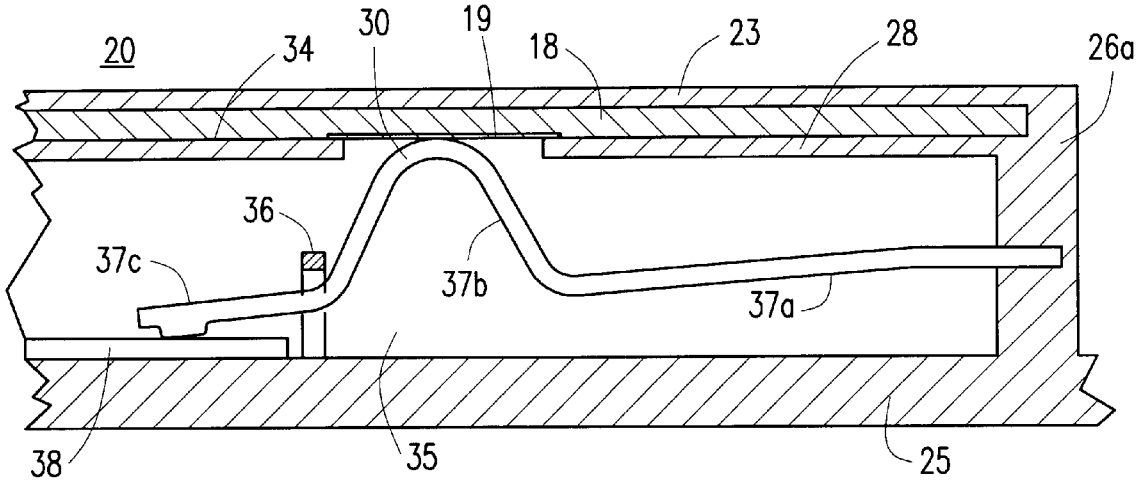
FIG. 6 is a schematic partial cross-sectional transverse view of the memory card device interior taken on the line A—A of FIG. 2 showing a side view of the preferred embodiment when a memory card is inserted into the memory card space.

FIG. 6 is a schematic partial cross-sectional transverse view of the memory card device interior taken on the line A—A of FIG. 2 (compare with FIG. 3) showing a side view of the preferred embodiment when a memory card 18 is inserted into the memory card space 32. The memory card 18 will force the n-shaped portion 37*b* in the direction towards the base cover 25. The extension portion 37*c* of the movable contact member 37 will be pushed from the grounding contact member 36 and its first protected position into contact with the signal contact member 38 and thereby a second signal conducting position of the movable contact member 37. The signal contact member 38 continues from the contact chamber 35 through one of the sidewalls 26*c* to the outer side of the device housing and ends in a signal contact terminal 38*a*. Other electronic components (e.g. a control unit) or a PCB of the electronic equipment device 10 is fixed by known methods to each terminal 38*a* of the signal contact member 38. The information stored within the memory card 18 is then accessible for use. When the memory card 18 is taken out of the receptacle device 20 the movable contact member 37 returns to its first position where the movable member 37 is unloaded.

Another embodiment of the invention will now be described with reference to FIGS. 7 and 8.

Figure 7:
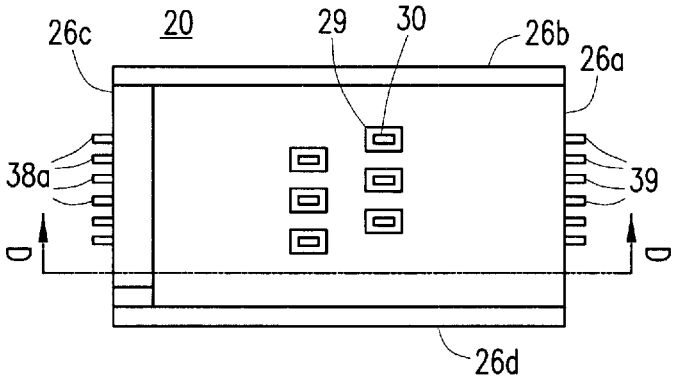
FIG. 7 shows a top view of a second embodiment of the invention.
Figure 8:
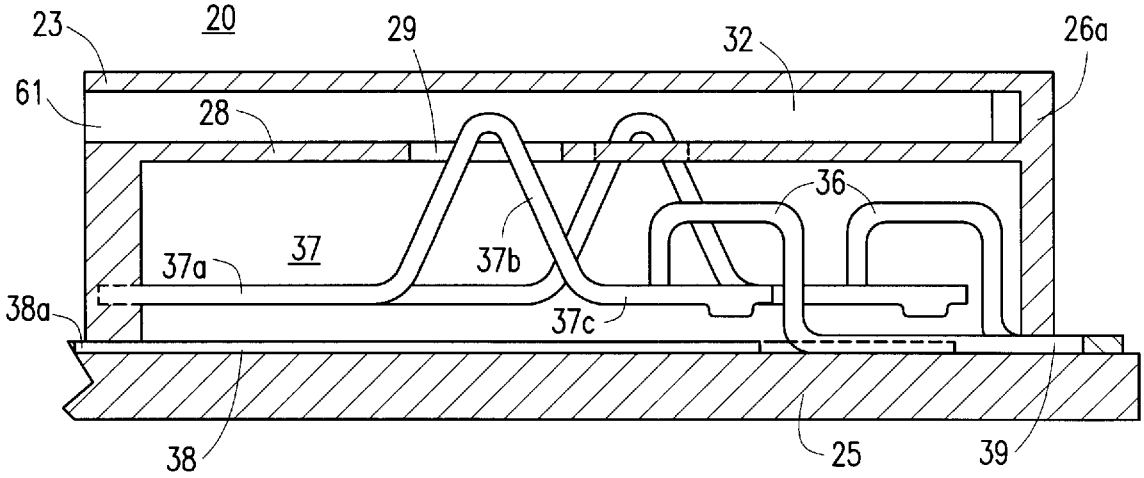
FIG. 8 is a schematic partial cross-sectional transverse view of the memory card device interior taken on the line D—D of FIG. 7 showing a side view of this second embodiment of the invention.

A top view revealing a memory card receptacle 20 is shown in FIG. 7, and FIG. 8 is a schematic partial cross-sectional transverse view of the memory card device 20 interior taken on the line D—D of FIG. 7 showing a side view of this second embodiment of the invention.

This embodiment is in most details identical to the previous embodiment described in FIGS. 2 and 3. This embodiment differs from the previous one only in that it has separate grounding contact members 36 for each of the movable contact members 37. Each one of the movable contact members 37 has a corresponding grounding contact member 36. A memory card receptacle 20 according to this embodiment has the same number of grounding contact terminals 39 as signal contact terminals 38*a* on the outside of the housing as shown in FIG. 7. It is favourable to have the grounding contact terminals 39 separated from the signal contact terminals 38*a* by having them located on different sides of the receptacle housing. All movable contact members 37 will be fixed to one of the sidewalls 26*a* as shown in FIG. 8. This embodiment has the advantage that a designer of electronic equipment devices can choose which of the contacts he wants to ESD protect if it isn't necessary to ESD protect all contacts as it is done in the first described embodiment.

Figure 9:
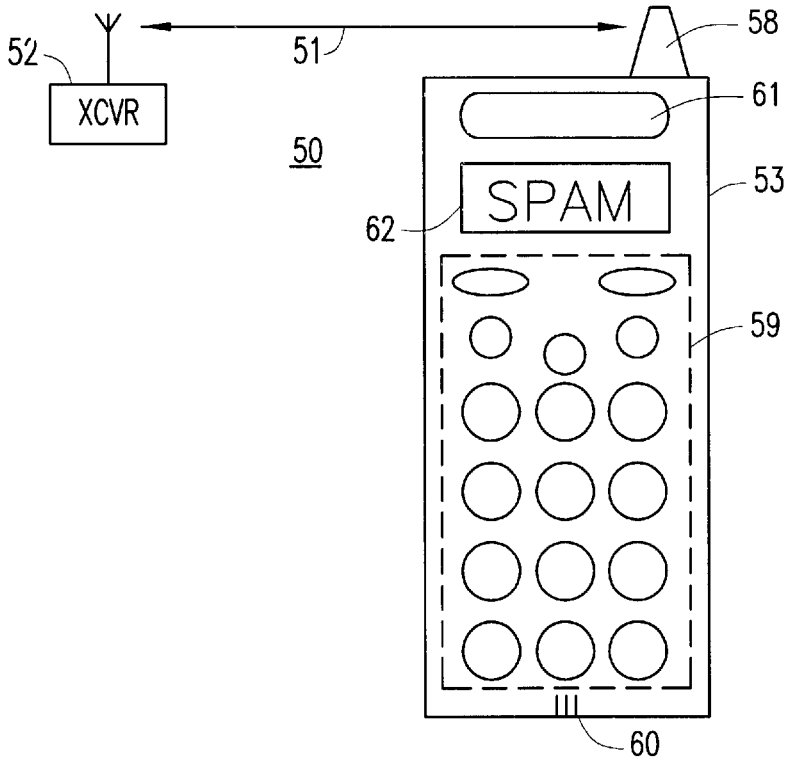
FIG. 9 is a schematic view of a mobile radio telecommunication system.
Figure 10:
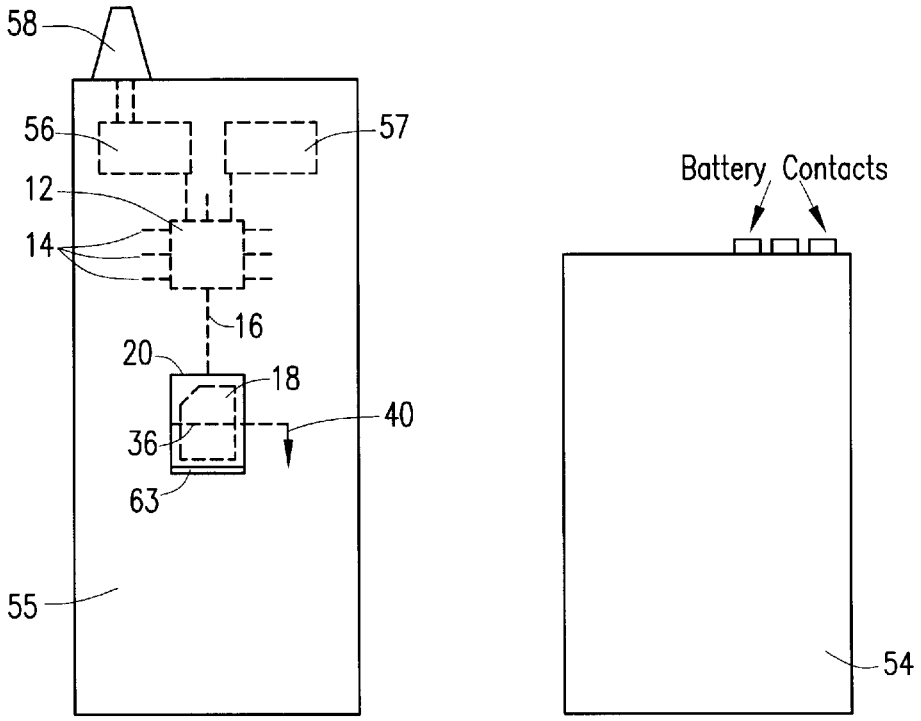
FIG. 10 is a schematic view of a detached portable mobile radio communication station according to the invention.

A mobile radio telecommunication system 50, as shown in FIGS. 9 and 10, transmits information signals 51 between a fixed site transceiver 52 and a portable radio mobile communication station 53. The portable radio station 53 comprises a battery portion 54 and radio portion 55 including a control unit 12, a transceiver 56, a user interface module 57 and an antenna 58. The transceiver 56 is responsible for receiving and transmitting the signal 51 between the fixed site transceiver 52 and itself. It is also responsible for verifying the subscriber's identification for billing purposes. The battery portion 54 is a detachable rechargeable power source used to power the electronics contained in the portable radio station. The antenna 58 transmits signals 51 to and receives signals 51 from a fixed site transceiver 52. The user interface module 57 contains a keypad 59, a display 62, a mouthpiece 60 and an ear piece 61. The memory card receptacle 20 is placed between the battery portion 54 and the radio portion 55 in this embodiment to protect the memory card receptacle 20 from the external environment. A slot or opening 63 enables a user to insert and eject the memory card 18.

The memory card receptacle 20 comprises at least one contact for electrically contacting a memory card 18. Said memory card receptacle 20 has at least one grounding contact member 36 for protecting electronic equipment 10 against Electro Static Discharge (ESD). Each contact 30 is in contact with a grounding contact member 36 when there is no memory card 18 in the device 20.

The memory card receptacle 20 is in this embodiment a SIM chip card reader 20 comprising at least one contact 30 for electrically contacting said SIM card 18 (Subscriber Identification Module). Said card reader 20 has at least one grounding contact member 36 for protecting electronic components of the portable radio terminal 53 against Electro Static Discharge (ESD), whereat at least one contact 30 is in contact with a grounding contact member 36 when there is no SIM card 18 in the card reader 20.

The SIM chip card reader 20 is used as an interface providing electrical connections between a SIM chip card 18 containing subscriber information and electronics internal to the portable transceiver 53. The SIM chip card 18 must be aligned within the SIM chip card reader 20 in order to obtain the information from the SIM chip card 18. The SIM chip card 18 is aligned with the sliding contacts contained within the SIM chip card chamber when the SIM chip card is slid into the opening 63 of the SIM chip card chamber 32, into the retention area 34. Here, the SIM chip card 18 will be retained until it is ejected by the user. The SIM chip card 18 is retained by a combination of the retention area 34 and the force of the sliding contacts 30. Once the SIM chip card 18 is retained in this position, the contacts 30 are coupled to the SIM chip card contacts 19, allowing the portable transceiver 54 access to the information stored within the SIM chip card 18. The electrical operation of the SIM chip card 18 is described in International Standards Organisation (ISO) Document #7816-3: 1988 (E),Technical Committee ISO/TC 97, Information Processing Systems, May 15, 1988 (First Edition).

The Invention is of course not limited to the above described and in the drawings disclosed embodiments but could be modified within the scope of the enclosed claims.

What is claimed is:

1. A memory card receptacle comprising:

at least one contact for electrically contacting a memory card; and a grounding contact for protecting electronic equipment against electro static discharge (ESD), wherein the at least one contact is in contact with the grounding contact when the memory card is not inserted in the memory card receptacle.

2. The memory card receptacle according to claim 1, wherein the grounding contact comprises at least one grounding contact member, the memory card receptacle comprising an equal number of grounding contact members as contacts.

3. The memory card receptacle according to claim 2, wherein each contact comprises a movable contact member and a signal contact member.

4. The memory card receptacle according to claim 3, wherein the memory card comprises a Subscriber Identification Module (SIM) chip card and the memory card receptacle comprises a SIM chip card reader.

5. The memory card receptacle according to claim 1, wherein the grounding contact comprises a grounding contact member that crosses all of the at least one contacts.

6. The memory card receptacle according to claim 5, wherein the grounding contact member is U-shaped.

7. The memory card receptacle according to claim 1, wherein each contact comprises a movable contact member and a signal contact member.

8. The memory card receptacle as in any of claims 5–7, wherein the memory card comprises a Subscriber Identification Module (SIM) chip card and the memory card receptacle comprises a SIM chip card reader.

9. A portable radio communication station having a Subscriber Identification Module (SIM) chip card reader, said SIM chip card reader comprising:

at least one contact for electrically contacting a SIM card; and a grounding contact for protecting electronic components of the portable radio station against Electro Static Discharge (ESD), wherein the at least one contact is in contact with the grounding contact when a SIM card is not installed in the SIM chip card reader.

10. The portable radio communication station of claim 9, wherein the grounding contact comprises at least one grounding contact member, the SIM chip card reader comprising an equal number of grounding contact members as contacts.

11. The portable radio communication station of claim 10, wherein each contact comprises a movable contact member and a signal contact member.

12. The portable radio communication station of claim 9, wherein the grounding contact comprises a grounding contact member that crosses all of the at least one contacts.

13. The portable radio communication station of claim 12, wherein the grounding contact member is U-shaped.

14. The portable radio communication station of claim 13, wherein each contact comprises a movable contact member and a signal contact member.

15. An electronic equipment device having a memory card receptacle, said memory card receptacle comprising:

a contact for electrically contacting a memory card; and a grounding contact for protecting electronic components of the electronic equipment device against Electro Static Discharge (ESD), wherein the contact is in contact with the grounding contact when a memory card is not installed in the memory card receptacle.

16. The electronic equipment device of claim 15, further comprising a plurality of contacts and a plurality of grounding contacts, the memory card receptacle having an equal number of contacts as grounding contacts.

17. The electronic equipment device of claim 16, wherein each contact comprises a movable contact member and a signal contact member.

18. The electronic equipment device of claim 15, further comprising a plurality of contacts, wherein the grounding contact comprises a grounding contact member that crosses each of the plurality of contacts.

19. The electronic equipment device of claim 18, wherein the grounding contact member is U-shaped.

20. The electronic equipment device of claim 18, wherein each contact comprises a movable contact member and a signal contact member.

21. The system of claim 15, further comprising a signal contact, wherein the contact is in contact with the signal contact when a memory card is installed in the memory card receptacle.

* * * * *